US005992410A

United States Patent [19]

Raleigh et al.

[11] Patent Number: 5,992,410

[45] Date of Patent: Nov. 30, 1999

[54] HIGH-EFFICIENCY FURNACE FOR MOBILE HOMES

[75] Inventors: William F. Raleigh, Santa Clarita, Calif.; Wayne R. Reedy, Cazenovia, N.Y.; Raymond P. Hampton, Irondale, Mo.; Donita M. Meyer, Fenton, Mo.; Kyu S. Hwang, Olivette, Mo.

[73] Assignee: Nordyne, Inc., St. Louis, Mo.

[21] Appl. No.: 09/074,818

[22] Filed: May 8, 1998

[51] Int. Cl.[6] ..... F24M 3/06; F24M 9/06; F23D 11/36

[52] U.S. Cl. ..... 126/110 AA; 126/110 R; 126/116 R; 431/171; 431/353; 431/156

[58] Field of Search ..... 126/110 R, 110 A, 126/110 AA, 110 C, 116 R, 106, 103, 91 A; 431/171, 354, 347, 353, 172, 156, 154; 165/158, 76; 417/350

[56] References Cited

U.S. PATENT DOCUMENTS

| | | | |
|---|---|---|---|
| 1,756,343 | 4/1930 | Charavay | 417/350 |
| 2,089,969 | 8/1937 | Kuenhold | 126/116 R |
| 2,220,604 | 11/1940 | Jepertinger | 126/116 R |
| 2,781,982 | 2/1957 | Merz | 417/350 |
| 3,144,076 | 8/1964 | Imars et al. | 431/171 |
| 3,500,814 | 3/1970 | De Lancey | 126/110 R |
| 3,601,116 | 8/1971 | Davis et al. | 126/110 AA |
| 3,672,349 | 6/1972 | Derringer | 126/110 AA |
| 3,794,014 | 2/1974 | McVickar et al. | 126/110 AA |
| 4,052,141 | 10/1977 | Dudheker et al. | 431/347 |
| 4,138,986 | 2/1979 | Combs et al. | 126/116 R |
| 4,333,524 | 6/1982 | Elkins et al. | 165/104.16 |
| 4,924,848 | 5/1990 | Vaughn | 126/110 |
| 5,042,453 | 8/1991 | Shellenberger | 126/110 |
| 5,293,860 | 3/1994 | Tomlinson et al. | 126/116 R |
| 5,368,011 | 11/1994 | Bodner | 126/116 R |
| 5,628,303 | 5/1997 | Ahmady et al. | 126/91 A |
| 5,636,786 | 6/1997 | Daneshvar | 236/11 |

FOREIGN PATENT DOCUMENTS

| | | | |
|---|---|---|---|
| 3-20525 | 1/1991 | Japan | 126/116 R |

OTHER PUBLICATIONS

Evcon Industries, Inc., brochure "The New Generation of Gas Furnaces for Manufactured Homes", copyright 1995.

Evcon Industries, Inc., Installation Instructions "Sealed Combustion Downflow Gas Furnaces", copyright 1995.

Nordyne, brochure "High–Efficiency Gas Furnace for Manufactured Homes", copyright 1993.

*Primary Examiner*—Ira S. Lazarus
*Assistant Examiner*—Sara Clarke
*Attorney, Agent, or Firm*—Cesari and McKenna, LLP

[57] ABSTRACT

An improved high-efficiency furnace for use with manufactured housing has a modular heat exchanger assembly having a drum and a plurality of serpentine shaped tubes. A burner extends at least partially into the drum portion of the heat exchanger which acts as a combustion chamber. Hot combustion gases flow upwardly within the drum and enter the tubes heating the drum and tubes. Room air is drawn into the furnace by a circulating blower and blown against the plurality of tubes. The room air is then directed to flow around the drum portion of the heat exchanger where it is further heated before being discharged into the space being heated. The burner includes an inwardly tilted target plate having a plurality of fingers for facilitating the formation of a stable ball of flame within the drum. A lower airbox which provides combustion air to the burner includes a smooth turn and a neck-down portion for reducing undesirable flow patterns and an axial combustion fan provides positive static pressure in the inlet airstream. With oil-fired burners, the furnace includes an improved ceramic combustion chamber having multiple openings and a groove channel.

25 Claims, 9 Drawing Sheets

HIGH-EFFICIENCY FURNACE FOR MOBILE HOMES

BACKGROUND OF THE INVENTION

1. Field of the Invention

This invention relates generally to the field of space heating, and more specifically to an improved high-efficiency furnace for use in heating mobile homes.

2. Description of the Related Art

To heat manufactured housing, such as mobile homes, forced hot air furnaces that are small and compact have been developed. These furnaces are often located in a closet or alcove of the mobile home. A blower or fan is typically used to draw room air to be heated into the furnace. The air is then blown downwardly past an enclosed heat exchanger, causing it to be heated. Heated air is then forced out of the furnace at its base, which is coupled to an arrangement of hot air ducts. These ducts typically run underneath the floor of the mobile home and include a number of outlets. Heated air is thus delivered to various parts or rooms of the mobile home.

Partially disposed within the heat exchanger, which also acts as a combustion chamber, is a burner assembly that typically runs on fuel gas (natural gas or propane) and includes a gas control and an ignitor. The burner assembly introduces a fuel-air mixture inside the combustion chamber which is ignited and burned, thereby heating the combustion chamber. Combustion gases and other reactants generated during the combustion process flow upwardly through the combustion chamber, exiting the furnace through an upwardly extending vent or chimney. As the hot combustion gases are moving upwardly through the heat exchanger, room air is being forced downwardly past the heat exchanger by the fan, as described above.

As shown in commonly owned U.S. Pat. No. 4,924,848, other heat exchangers in addition to the combustion chamber may also be utilized to improve the efficiency of the furnace. For example, a radiator which receives combustion gases from the combustion chamber may be disposed adjacent to the fan in order to extract additional heat from the combustion gases before they are discharged from the furnace. More specifically, room air is first drawn past the radiator before it enters the fan, so the air is pre-heated. This pre-heated air is then blown downwardly by the fan past the combustion chamber where it is further heated before being discharged through the furnace outlet.

An intermediary heat exchanger, which interconnects the combustion chamber and the radiator, may also be provided. The intermediary heat exchanger may consist of a plurality of horizontal tubes that extend from the top of the combustion chamber to the base of the radiator, allowing combustion gases to flow therebetween. The tubes, moreover, may be disposed directly below the downward facing fan outlet so that the air being heated first flows past the intermediary heat exchanger and then past the combustion chamber.

Although the furnace disclosed in U.S. Pat. No. 4,924,848 represents a significant improvement in compact furnace designs, it nonetheless has several limitations. First, while the radiator indeed provides some improvement to the operating efficiency of the furnace, its design nonetheless has several drawbacks. In particular, the thin, box-like radiator is typically mounted along one of the side walls of the furnace housing, facing one of the fan inlets. That is, the radiator is positioned parallel to the direction of air entering the furnace, but orthogonal to the direction of the air entering the fan. Due to the relative positioning of the fan and the radiator, air being drawn into the fan typically flows across only one surface of the radiator, limiting the amount of preheating performed by the radiator. In addition, a significant amount of room air enters the fan through its second inlet which is opposite the radiator and is thus not preheated at all.

Furthermore, mobile homes obviously come in many different sizes and floor plans. Accordingly, it is desirable to provide a furnace that may be easily modified so as to increase or decrease its thermal output depending on its intended environment. Nevertheless, the furnace disclosed in U.S. Pat. No. 4,924,848 does not lend itself to easy modification. For example, all three heat exchanger components must be installed and used for the furnace to operate, making it extremely difficult, if at all possible, to adjust the furnace's thermal output. It is also desirable to provide a single furnace design that may accommodate either home heating oil or natural gas burners with little, if any, modification. The configuration of the burner assembly, however, varies significantly depending on whether it burns oil or gas and also whether it operates under pressure or natural draft conditions. Due to these configuration differences, the inlet formed in the combustion chamber must be sized for the particular burner assembly being installed. For example, if the combustion chamber is to accept a natural draft burner which typically utilizes a venturi and pilot assembly, the inlet configuration includes a relatively small diameter opening. This inlet configuration, however, prevents the combustion chamber from accepting, for example, an oil-fired burner which typically includes an outer tube and mounting flange, thereby requiring a different (often larger) inlet configuration. Thus, a different chamber design is required for each burner type.

The burner assembly itself may also introduce several inefficiencies to the operation of the furnace. For example, as mentioned above, in order to permit the burner assembly to extend partially into the combustion chamber, a large inlet is often formed in the base of the combustion chamber. Ideally, the burner assembly generates a steady, round ball of flame, centrally disposed within the drum so as to heat the drum evenly. Conventional burner assemblies, which often include flat, rectangular spreader plates, however, typically produce fluctuating and/or misshaped flames, resulting in uneven heating of the combustion chamber. This uneven heating of the combustion chamber, in turn, results in less efficient heat transfer to the room air being blown downwardly by the fan.

Additionally, the lower airbox which is mounted to the base of the combustion chamber and delivers combustion air to the burner assembly often introduces undesirable flow characteristics, such as nonuniformity, into the airflow being provided to the burner assembly. This nonuniformity may result in inefficient and unstable operation of the burner assembly. For example, the airflow may fluctuate over time, causing instabilities in the operation of the burner assembly. These instabilities often reduce the operating efficiency of the furnace.

With many furnaces a blower is provided to increase the static pressure of the air being supplied to the burner assembly, thereby improving the heat transfer process by establishing forced convection. The blower additionally forces the combustion gases and reactants through the furnace and out the vent. To generate the requisite increase in static pressure economically, centrifugal sheet metal blowers are typically employed. These types of blowers, however, present several disadvantages. For example, a centrifugal blower, by design, tends to have a small outlet with a non-uniform, high velocity airflow, which often disrupts the flow of air into the burner (a highly undesirable effect for the reasons described above). The placement and installation of a centrifugal blower also results in added complexity to the furnace. Centrifugal blowers are also relatively expensive components, increasing the overall costs of the furnace.

Oil-fired furnaces often include a ceramic combustion chamber to protect the heat exchanger from the intense, often localized flame of an oil-fired burner. These chambers, which are typically disposed in an upright manner within vertical heat exchangers, include a side opening form receiving the oil-fired burner and an opening in the top end for releasing the flame and heat. Although these designs are generally acceptable, the applicants herein have identified several disadvantages. For example, the flame and heat are mainly directed upwardly causing non-uniform heating of the heat exchanger. Additionally, these chambers are problematic to install and position within the heat exchanger due, at least in part, to the large opening required for their assembly within the heat exchanger.

SUMMARY OF THE INVENTION

It is an object of the present invention to provide an improved high-efficiency furnace.

It is a further object of the present invention to provide an improved furnace having a flexible heat exchanger system so as to allow adjustment of the thermal output of the furnace.

It is another object of the present invention to provide an improved furnace that generates a steady, even ball of flame centrally within the heat exchanger for evenly and efficiently heating the heat exchanger.

Yet another object of the present invention is to provide an improved furnace that provides for uniform airflow to the burner assembly.

A still further object of the present invention is to provide an improved furnace having an optional combustion fan for increasing the static pressure of the inlet air without causing undesirable flow characteristics.

A still further object of the present invention is to provide an improved combustion chamber for evenly distributing the heat of an oil-fired burner and for facilitating installation.

Briefly, the improved high-efficiency furnace of the present invention includes a modular drum and tube heat exchanger assembly for use in heating room air to a desired temperature. The furnace further includes a circulating blower which draws room air to be heated into the furnace and directs the air, in a generally horizontal direction, against the tubes of the heat exchanger. The air is then turned downwardly by a rear wall of the furnace housing and flows past the drum portion of the heat exchanger. The heated air is discharged through the base of the furnace where it may be dispersed into the space being heated. The drum preferably constitutes the lower portion of the heat exchanger and is disposed below the blower. A burner assembly extends at least partially into the drum portion of the heat exchanger, which acts as a combustion chamber. Extending upwardly from a top surface of the drum are a plurality of serpentine.-shaped tubes. The tubes preferably include a horizontal portion that may be disposed below the blower and a vertical portion which extends alongside the blower. Significantly. the number, diameter and configuration of tubes extending from the drum portion of the heat exchanger may be easily modified so as to adjust the thermal output of the furnace. For example, by simply increasing the number of tubes and the firing rate of the burner assembly, the thermal output of the furnace may be increased without otherwise modifying the other components or dimensions of the furnace.

Mounted to the base of the drum may be a lower airbox that includes a smoothly curved air inlet channel that turns the flow of inlet air ninety degrees from a vertical to a horizontal direction. The air inlet channel of the lower airbox further includes a neckdown portion that, in combination with the smooth turn, reduces the formation of undesirable flow patterns, such as nonuniformity. The burner assembly is mounted to the lower airbox and, as mentioned above, extends into the drum. The inner surface shape of the lower airbox provides for a steady flow of combustion air to the burner, aiding in the generation of a stable flame while being relatively easy and economical to manufacture.

In the illustrated embodiment, the burner assembly of the improved high-efficiency furnace may include an inwardly tilted target plate against which the flame generated by the burner is directed. In particular, the target plate is tilted back toward the burner assembly approximately twenty-five degrees so as to redirect a portion of the flame back toward the burner. The target plate may also includes a plurality of fingers that extend outwardly from an upper surface of the target plate within the plane defined by the plate. The combination of the inward tilt and the fingers causes a portion of the flame to be directed back toward the burner and a portion to be passed between the fingers, facilitating the formation of a round ball of flame that evenly and efficiently heats the drum portion of the heat exchanger. By spacing the fingers slightly apart, moreover, the mixing of fuel and air may be enhanced, thereby improving the combustion process.

The improved high-efficiency furnace may further include an axial combustion fan disposed in the inlet airstream. The combustion fan preferably includes two spaced-apart, axially aligned propellers powered by a single dual-shaft electric motor which may be disposed between two propellers. Also disposed between two propellers is a stator assembly for straightening the airflow exiting the upstream propeller and supporting the motor. Alternatively, a single propeller and downstream stator may be employed. Utilization of the stator assembly increases the static pressure generated by the combustion fan. Preferably mounted upstream of the combustion fan is an orifice plate having an orifice that is sized to provide optimum airflow during the combustion process. A pressure probe may be mounted on each side of the orifice plate. The difference in pressure across the orifice plate, as sensed by the two pressure probes, confirms operation of the combustion fan by detecting a decrease in static pressure. (Once it is established that the combustion fan is operating properly, the burner assembly may be safely activated and the corresponding fuel-air mixture ignited and burned inside the heat exchanger.

The furnace may further include an improved ceramic combustion chamber disposed within the drum of the heat exchanger for use with oil-fired burners. The combustion chamber preferably has a cylindrical outer wall having upper and lower portions. A primary opening is formed in the upper portion of the outer wall and a plurality of secondary openings are preferably formed in the lower portion. A conical entry may be formed at a first end of the chamber for receiving a nozzle segment of the oil burner. A second end may have a detent for mating engagement with a bracket located along the inner surface of the drum for ensuring and facilitating secure installation of the chamber. In addition, upon installation, the axis of the cylindrical chamber is orthogonal relative to the drum. The chamber may also include a groove passageway along the upper portion of the outer wall to allow viewing of the flame during operation of the burner.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
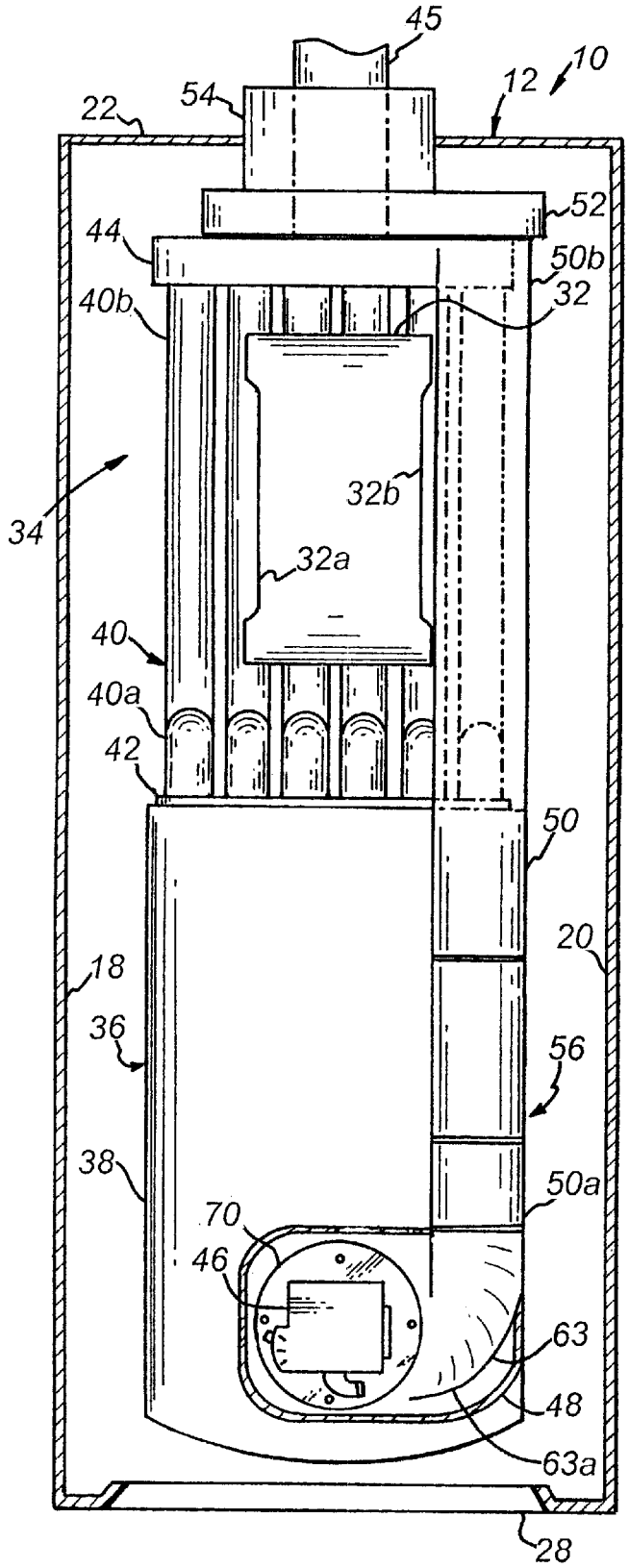
FIG. 1 is a front view of the improved high-efficiency furnace of the present invention with the furnace housing partially removed.
Figure 2:
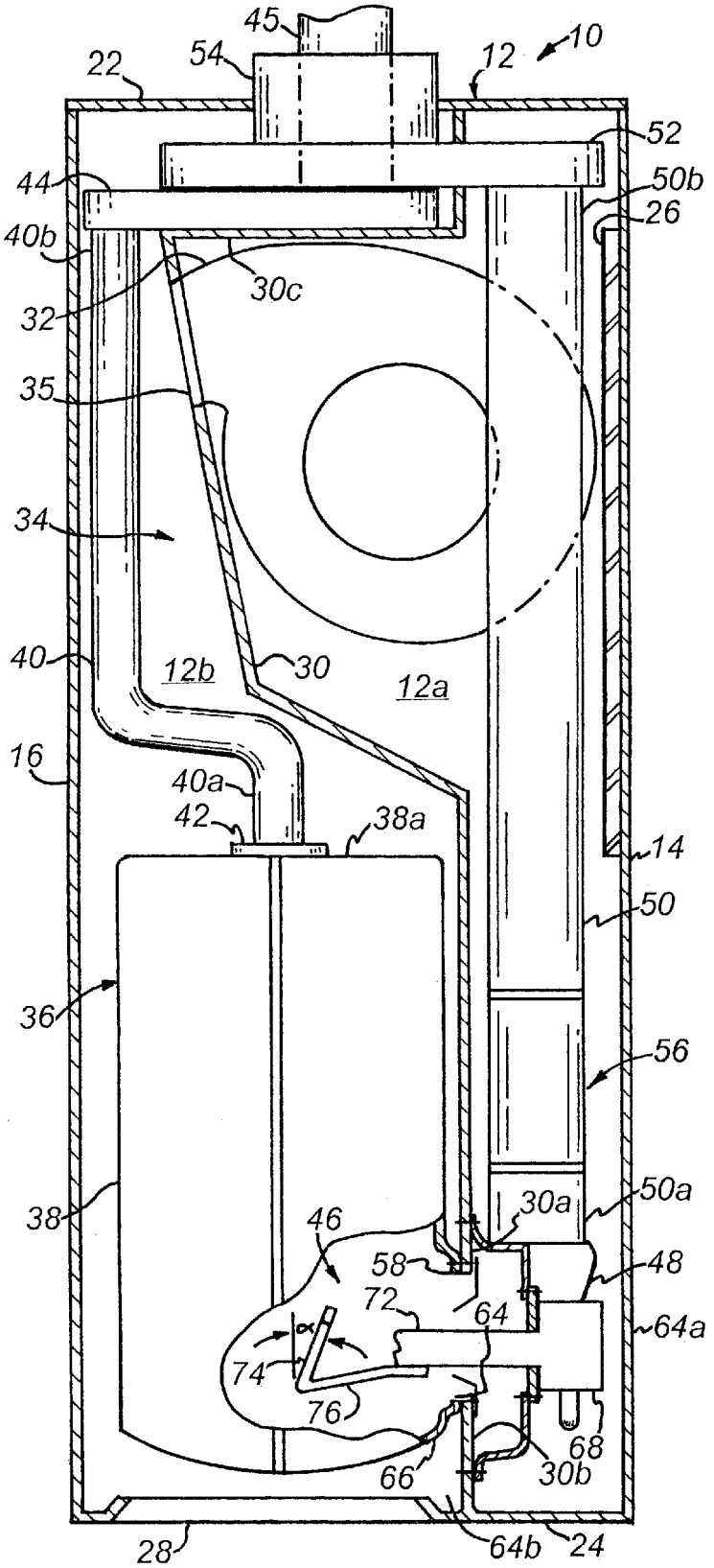
FIG. 2 is a side view of the furnace of FIG. 1 with the housing partially removed and the drum cut-away to reveal the burner assembly.

FIGS. 1 and 2 are front and side views, respectively, of an improved high-efficiency furnace 10. The furnace 10 is preferably disposed within a cabinet or housing 12 having a front door 14, a back wall 16, a left side wall 18, a right side wall 20, a top wall 22 and a base 24. Disposed along the front door 14 of the housing 12 is a set of louvers 26, which allow room air that is to be heated to enter the housing 12. An outlet 28 is located at the base 24 of the housing 12 to permit heated air to be distributed throughout the corresponding space (e.g., through a series of ducts beneath the floor of a mobile home). A generally vertically extending intermediary wall 30 (FIG. 2) is preferably disposed inside the housing 12 so as to divide the housing 12 into a forward compartment 12*a* and an aft compartment 12*b*. The intermediary wall 30 preferably extends between the two side walls 18, 20 and includes a passageway 30*a* at a lower end 30*b* thereof. For purposes of illustration, the intermediary wall 30 is not shown in FIG. 1.

The furnace 10 further includes a circulating blower. 32 preferably disposed in an upper portion 34 of the forward compartment 12*a* of housing 12. The circulating blower 32, which may be a conventional, electrically powered centrifugal blower, has two opposing inlet ports 32*a* and 32*b* (FIG. 1) and may be mounted to intermediary wall 30 by any conventional means, such as fasteners (not shown). Circulating blower 32 also includes an outlet 35 (FIG. 2) extending through intermediary wall 30 for directing room air in a generally horizontal direction toward the back wall 16 of housing 12. A heat exchanger assembly, designated generally by reference numeral 36, is disposed within the aft compartment 12*b*. The heat exchanger assembly 36 includes two main components: a drum 38 which serves as a combustion chamber, and a plurality of tubes 40. The drum 38 is preferably cylindrically or elliptically shaped and includes a top surface 38*a*. Drum 38 may be formed from steel and may be mounted to housing 12 by any conventional means, such as brackets and fasteners (not shown).

Extending upwardly from drum 38 in a serpentine shape are the tubes 40. More specifically, inlet portions 40*a* of the tubes 40 extend upwardly from an inlet manifold plate 42 that is attached to the top surface 38*a* of drum 38. Inlet manifold plate 42 preferable includes a separate opening for each tube 40. In a preferred embodiment, the tubes 40 are then bent horizontally to extend toward back wall 16 of housing 12. At back wall 16, the tubes 40 are bent vertically to extend upwardly within housing 12, adjacent to but spaced slightly from the back wall 16. Upper portions 40*b* of tubes 40 are connected to a collector 44. The collector 44, which may be formed from two opposing halves welded together, is preferably disposed within housing 12 above circulating blower 32 and along an upper, horizontal portion 30*c* of intermediary wall 30. Extending upwardly from the collector 44 is a flue connector 45. The flue connector 45 extends through the top wall 22 of housing 12 and may be coupled to a vent (not shown) for exhausting by-products of the combustion process, as described below.

It should be understood that a manifold plate may be used to connect the tubes to the collector.

The furnace 10 further includes a burner assembly 46, a lower airbox 48 and an inlet air conduit 50. The burner assembly 46 is preferably mounted to the lower airbox 48 which, in turn, is mounted to the front of intermediary wall 30 relative to forward compartment 12*a* at the passageway 30*a*. The drum 38 includes an opening 58 formed at a lower portion thereof, which is mounted to the rear of intermediary wall 30 at passageway 30*a* opposite the lower airbox 48. The inlet air conduit 50 is preferably vertically disposed within the housing 12. In particular, a lower end 50*a* of inlet air conduit 50 is attached to the lower airbox 48 and an upper end 50*b* of the conduit 50 is attached to a plenum 52. The plenum 52 is disposed between the collector 44 and the top wall 22 of housing 12. Plenum 52 includes a collar 54 which extends through top wall 22 and is concentrically disposed around flue connector 45. That is, collar 54 defines an annular ring (not shown) about the flue connector 45 through which inlet air may be drawn into the furnace 10 as described below. Disposed within conduit 50 may be a combustion fan 56, described in detail below. Combustion fan 56 is utilized to assist combustion and force combustion gases through the furnace 10 by overcoming the pressure drop within the heat exchanger 36.

Figure 3:
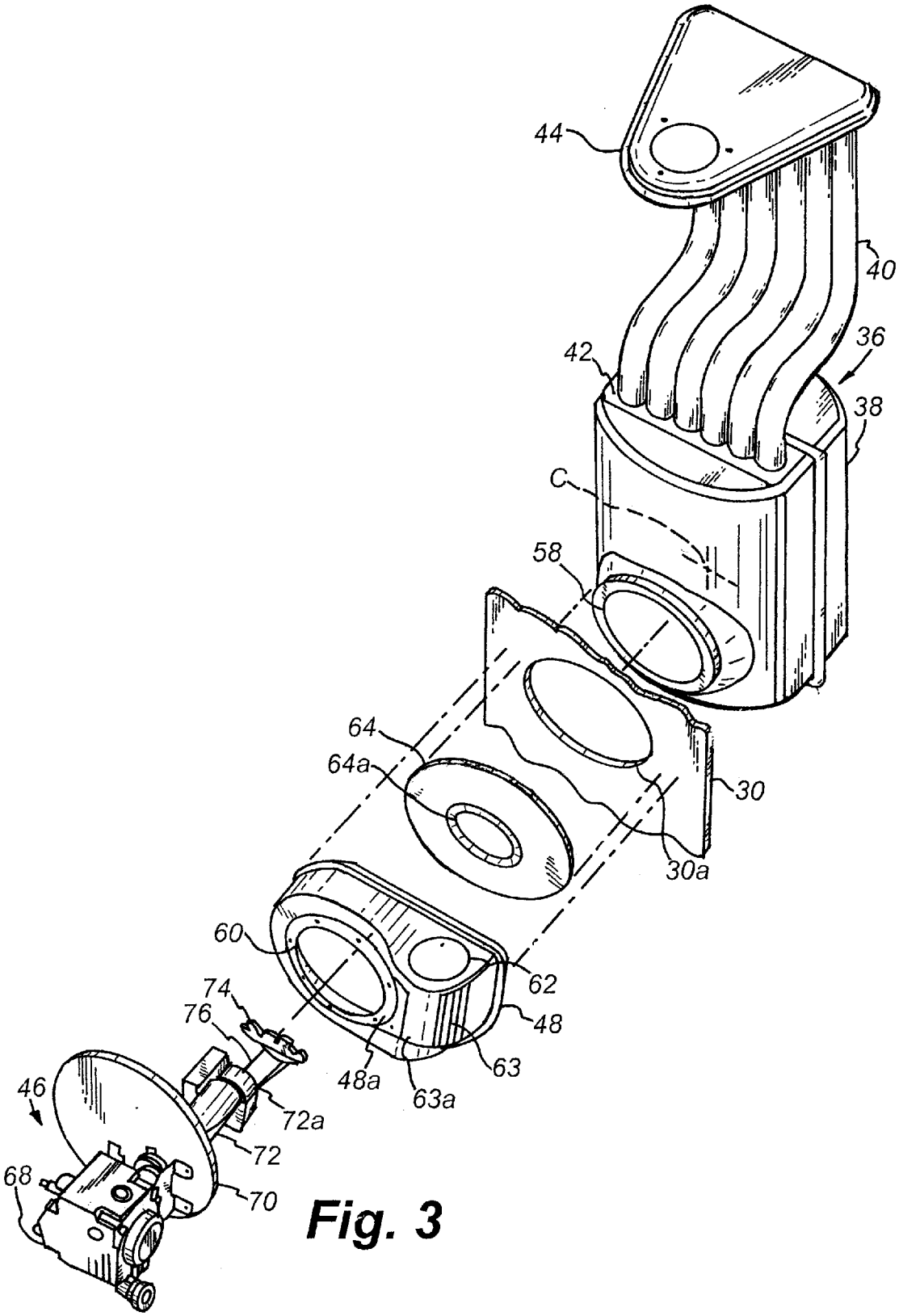
FIG. 3 is an exploded, perspective view of several components of the furnace of FIG. 1.

With reference to FIG. 3, the drum opening 58 is mounted to the rear side of intermediary wall 30 at its passageway 30*a*. Mounted on the front side of intermediary wall 30 at passageway 30*a* is an entry plate 64 having a mouth 64*a* that may have a truncated cone shape. The mouth 64*a* of entry plate 64 preferably extends through passageway 30*a* and, at least partially, into drum 38 through drum opening 58. The lower airbox 48, which includes a first opening 60, is also mounted to the front of intermediary wall 30 at passageway 30*a*. Specifically, the lower airbox 48 is mounted to intermediary wall 30 over entry plate 64 such that the interior of the drum 38 is accessible via the first opening 60 in airbox 48, the mouth 64*a* of entry plate 64 and drum opening 58. Lower airbox 48 also includes a second opening 62 that is approximately orthogonal to the first opening 60. Inlet air conduit 50 (FIG. 1) attaches to the second opening 62 of lower airbox 48 so as to furnish lower airbox 48 with a supply of combustion air.

Burner assembly 46 includes a gas valve or gas control 68 attached to a mounting bracket 70, which may be a plate. A venturi tube 72 having outer end 72*a* extends from the gas valve 68. Spaced from the outer end 72*a* of venturi tube 72 and facing back toward the tube 72 and gas valve 68 is a generally planar target plate 74. Target plate 74 is preferably mounted to an arm 76 that extends from venturi tube 72 opposite gas valve 68.

As shown, lower airbox 48, entry plate 64 and drum 38 mount to intermediary wall 30 at passageway 30*a* so that the interior of drum 38 is accessible through the first opening 60 of lower airbox 48. Lower airbox 48, entry plate 64 and drum 38 may be attached to intermediary wall 30 by fasteners and gaskets (not shown). The mounting bracket 70 of burner assembly 46 is then fastened over the first opening 60 of lower airbox 48. Specifically, bracket 70 mounts to a receiving face 48*a* of lower airbox 48 such that venturi tube 70 and target plate 74 extend through the lower airbox 48 and entry plate 64 and into drum 38. More specifically, bracket 70 and receiving face 48*a* are preferably in cooperating relationship such that, upon mounting burner assembly 46 to lower airbox 48, venturi tube 72 is directed toward a center point C within drum 38.

The lower airbox 48 also includes a smoothly curved air inlet channel 63 coupled to second opening 62. The inlet channel 63 turns the flow of inlet air received at second opening 62 approximately ninety degrees from a vertical to a horizontal direction. The inlet air channel 63 is preferably smoothly formed so as to reduce undesirable flow characteristics such as nonuniformity and turbulence as the air is turned and provided to the burner assembly 46. The air inlet channel 63 further includes a neck-down portion 63*a* that provides for pressure recovery (i.e., an increase in static air pressure) and further reduces the formation of turbulence within the airbox 48.

Figure 4:
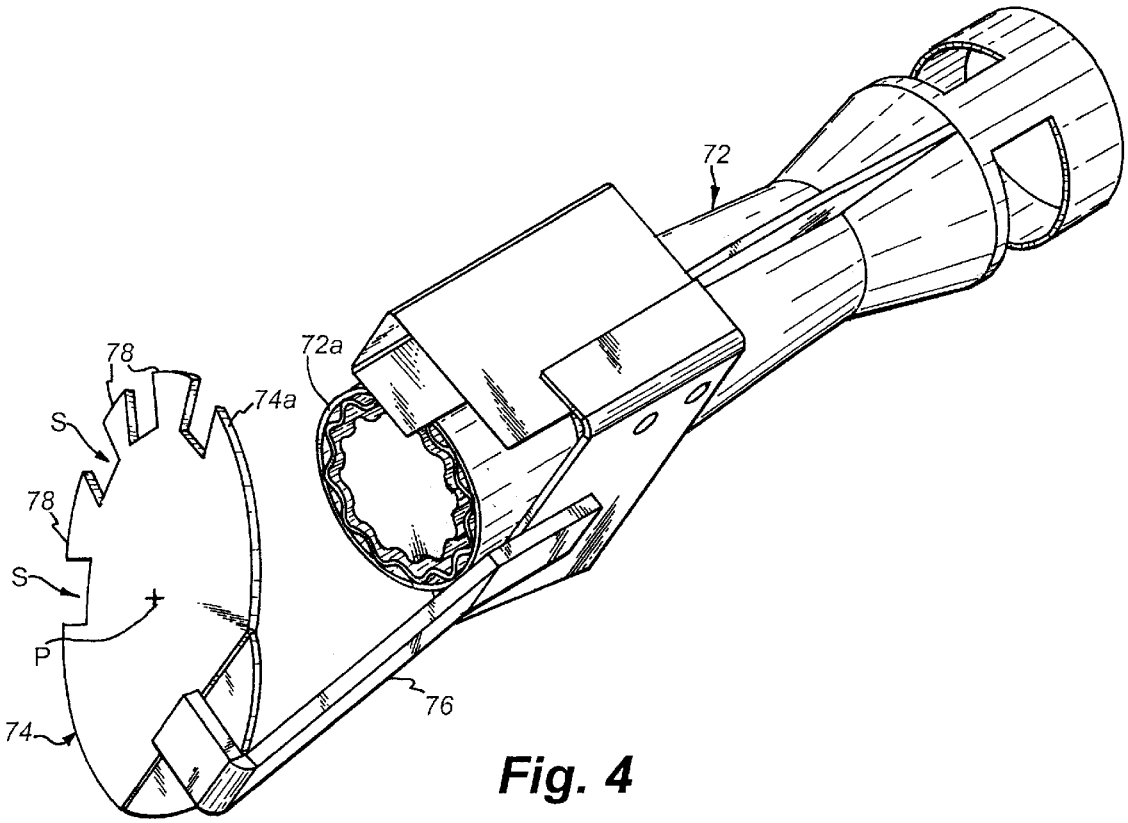
FIG. 4 is an isometric view of the burner assembly of the furnace of FIG. 1 illustrating the inwardly tilted target plate.

FIG. 4 is an isometric view of the venturi tube 72 portion of burner assembly 46. As mentioned above, the planar target plate 74 is spaced from and faces the end 72*a* of venturi tube 72. In particular, target plate 74 is mounted to arm 76 that extends outwardly from the end 72*a* of venturi tube 72. Target plate 74 preferably has a generally circular platform and is inwardly titled toward venturi tube 72. More specifically, target plate 74 is tilted inwardly from a vertical plane toward venturi tube 72 by an angle $\alpha$ (FIG. 2), which preferably is approximately twenty-five degrees. Furthermore, arm 76 may be bent slightly downward so that a greater portion of target plate 74 faces the end 72*a* of venturi tube 72. In addition to the inward tilt, target plate 74 also includes a plurality of fingers 78 along an upper surface 74*a* of the plate 4. The fingers 78 project outwardly relative to a center point P of the target plate 74 within the plane defined thereby. Fingers 78 also define corresponding spaces S therebetween. As described below, utilization of target plate 74 significantly improves the performance of the burner assembly 46 and the corresponding efficiency of furnace 10.

Figure 5A:
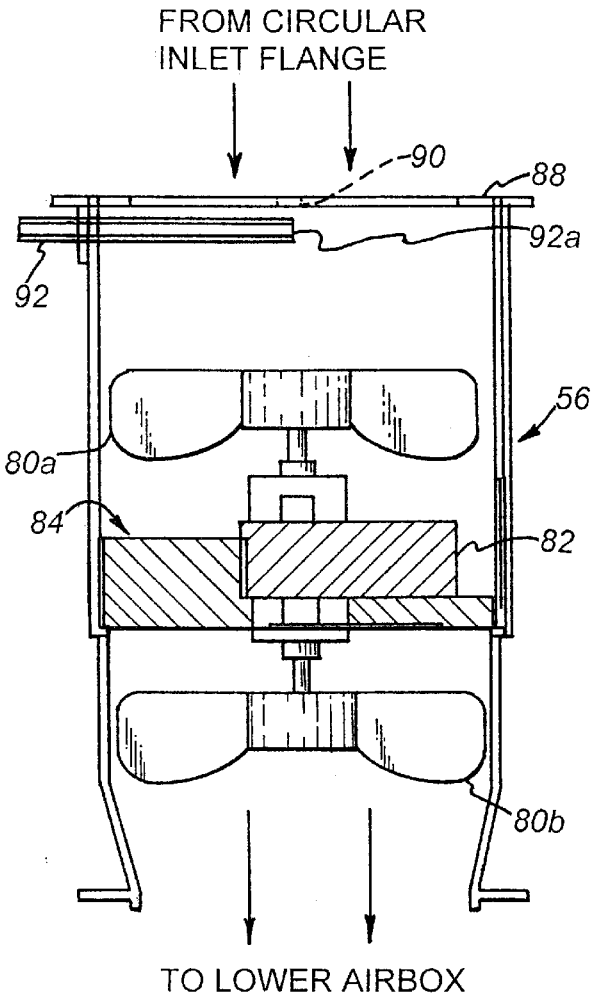
FIG. 5A is a side view of the axial combustion fan of the furnace of FIG. 1.
Figure 5B:
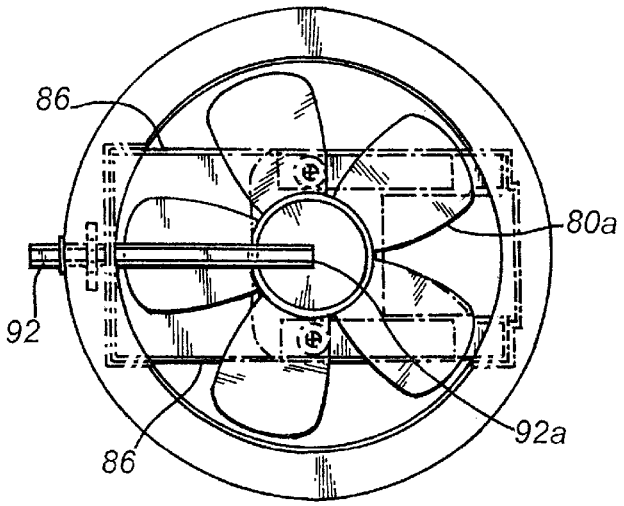
FIG. 5B is a top view of the axial combustion fan of FIG. 5A.

FIGS. 5A and 5B are side and top views, respectively, of the combustion fan 56. As discussed above, combustion fan 56 is preferably disposed within the air inlet conduit 50 (FIGS. 1 and 2). Fan 56 preferably includes two axially aligned propellers 80*a*, 80*b* and a motor 82 for driving the propellers 80. Disposed between adjacent propellers 80*a*, 80*b* is a stator 84. Stator 84 preferably includes one or more vanes 86 (FIG. 5B) that are oriented within a plane parallel to and/or including the central axis of air inlet conduit 50 so as to straighten the air exiting the propeller 80*a* upstream of the stator 84. That is, the upstream propeller 80*a* increases the static pressure of the flow, but also imparts a whirl component to the air exiting the upstream propeller 80*a*. To improve the additional pressure increase provided by the downstream propeller 80*b*, the air is straightened (i.e., returned to a generally axial direction relative to the inlet conduit 50) prior to entering the downstream propeller 80*b* by stator 84. The vanes 86 may extend the full inside diameter of the combustion fan 56.

To reduce drag, motor 82 is preferably mounted directly on the vanes 86, rather than on separate mounting brackets. Motor 82 may be affixed to vanes 86 by conventional means, including right angle flanges and fasteners (not shown). Motor 82 is preferably a dual shaft electric motor so as to drive propellers 80*a*, 80*b* on opposite sides of the motor 82. In the illustrated embodiment, the vanes 86 of stator 84 are flat surfaces formed from sheet metal to simplify their construction and installation. Nonetheless, it should be understood that vanes 86 may be curved so as to avoid stall or flow separation at the leading edges of the vanes 86.

Disposed upstream of combustion fan 56 is an orifice plate 88 with a centrally disposed orifice 90. Orifice plate 88 and the corresponding orifice 90 present an obstruction to the flow of combustion air flowing through inlet air conduit 50. By adjusting the size of the orifice 90, the flowrate through the inlet air conduit 50 may be controlled. In particular, the orifice 90 is preferably sized so as to optimize the airflow being provided to the burner assembly 46 (FIGS. 1 and 2). On the downstream side of the orifice plate 88 is a pressure probe 92 having a tip 92a which extends into the airstream flowing through the inlet air conduit 50. The pressure probe 92 monitors the static air pressure in the airflow downstream of the orifice plate 88. A static pressure tap (not shown) may be disposed in the wall of the inlet air conduit 50 upstream of orifice plate 88 and is used in cooperation with pressure probe 92, as described below. To improve its operation, the tip 92*a* of pressure probe 92 is preferably backed-off from the center of inlet air conduit 50 by an amount equal to one-tenth of the inside diameter of the inlet air conduit 50.

It should be understood that a single propeller and downstream stator may be employed within the combustion fan, rather than the dual propeller arrangement illustrated in FIG. 5A. Furthermore, in the preferred embodiment, the orifice plate 88 is preferably disposed further up the inlet air conduit 50 than as otherwise shown in FIG. 5A.

Operation of the improved high-efficiency furnace 10 is under the direction of suitable control circuitry and proceeds as follows. First, upon detecting a call for heat (e.g., from a room thermostat), control circuitry activates combustion fan 56, causing motor 82 to begin rotating the propellers 80*a*, 80*b*. Rotation of propellers 80*a*, 80*b* draws air through the inlet air conduit 50, past the orifice plate 88 and moves it into lower airbox 48. Additional combustion air is drawn into inlet air conduit 50 through collar 54. Movement of air through the orifice plate 88 creates a pressure differential sensed by the static pressure tap and pressure probe 92, thereby confirming operation of combustion fan 56. In response to the pressure readings, control circuitry activates the gas valve 68 of burner assembly 46, causing a fuel-air mixture to be created and directed through venturi tube 72 toward inwardly tilted target plate 74 and ignited. The resulting flame strikes the target plate 74 and is partially re-directed back toward the opening 58 in drum 38 due to the inward tilt of plate 74 and fingers 78. Some of the flame moves past the target plate 74 and is thus not re-directed back toward opening 58. This is, a portion of the flame moves through the spaces S between adjacent fingers 78, preventing a recirculating pattern from developing and assisting in the establishment of a stable ball of flame within drum 38. The spaces S between fingers 78 also allow additional combustion air to feed the resulting flame, thereby improving the fuel-air mixture In sum, inwardly tilted target plate 74 ensures that a stable ball of flame is created for more efficiently heating the drum 38.

Hot combustion gases and other reactants generated by the combustion process flow upwardly within drum 38. The combustion gases reach the top surface 38*a* of drum 38 and enter the tubes 40 via inlet manifold plate 42. The combustion gases then flow through the tubes 40 and are collected in collector 44. Here, the combustion gases and reactants flow into the flue connector 45 and are discharged from the furnace 10. This flow of hot combustion gases heats the drum 38 and tubes 40 of heat exchanger 36. After allowing the heat exchanger 36 to warm up, control circuitry (e.g., through a thermal switch or timer) activates the circulating blower 32, thereby drawing room air through louvers 26 and into inlet ports 32*a*, 32*b*. Since the outlet 35 of fan 32 is pointed in a generally horizontal direction toward back wall 16, room air is blown by circulating blower 32 through outlet 35 against upper portions 40*b* of tubes 40 which are disposed adjacent to but spaced from the back wall 16 of housing 12. As it flows past the tubes 40, the room air is heated. The room air is then directed downwardly within the aft compartment 12*b* of housing 12 by back wall 46. Specifically, the room air next flows around the drum portion 38 of heat exchanger 36, where it is further heated. Heated air then exits furnace 10 through outlet 28 where it is delivered to the space being heated.

It should be understood that burner assembly 46, including gas valve 68, may be operated under ambient or natural draft conditions. That is, burner assembly 46 may be operated without utilization of combustion fan 56.

The modular drum and tube arrangement of heat exchanger 36 described herein provides substantial flexibility in selecting the desired thermal output of the furnace 10, in response to the desired thermal input (e.g., firing rate or fuel flow rate at the burner). In particular, the number of tubes may be increased or decreased so as to change the effective surface area of the tubes without requiring a wholesale re-design of the furnace 10. Increasing the number of tubes, for example, generally increases the total surface area available for heat transfer and thus results in more heat being transferred to the room air. Similarly, by decreasing the number of tubes, the available surface area is decreased and less heat transfer occurs. The number of tubes also affects the flow resistance within the tubes, which may preclude operation of the furnace 10 under natural draft conditions and, instead, require the use of a combustion fan.

When modifying the number of tubes 40, the number of openings in the inlet manifold plate 42 and collector 44 is modified accordingly. For example, if the number of tubes is reduced, fewer openings are formed in plate 42 and collector 44. In the preferred embodiment, the heat exchanger 36 includes between four and six parallel tubes, each having an outside diameter of one and three-quarters (1.75) inches.

As indicated above, by adjusting the number of tubes and/or their diameter, the heat exchanger may be operated under natural draft (i.e., buoyant) conditions. For example, by using six tubes, the furnace 10 may be operated under natural draft conditions with an efficiency of approximately 76% based on a thermal input of 70 kBTUs. That is, the number and diameter of the tubes would be sufficient to draw combustion gases through the heat exchanger and into the collector 44 without the assistance of a combustion fan. By eliminating the combustion fan 56, the overall cost of the furnace can be reduced. Alternatively, the inside diameters of the tubes may be reduced, one or more tubes may be removed (decreasing the available surface area) and a combustion fan utilized to ensure that the combustion gases are moved through the narrow tubes. The combustion fan also provides a scrubbing action along the inside surfaces of the tube, enhancing heat transfer. For example, with four tubes and a combustion fan, a thermal input of 77 kBTUs again results in an efficiency of approximately 76%. In sum, the flexibility provided by modular drum and tube heat exchanger 36 allows a designer to optimize the combination of available external surface area (to increase the rate of heat transfer) and inner tube diameter (to allow natural draft to occur).

Other tube arrangements and geometries are also possible in addition to those described above. For example, the tubes 40 (FIG. 2) of the heat exchanger, rather than including a single horizontal section, may first be bent forward toward compartment 12*a*, then upwardly and then backwards toward back wall 16 before extending vertically along the back wall 16. That is, with reference to FIG. 2, the tubes 40 may include a backwards C configuration to provide even greater heat transfer to the room air being heated by the furnace 10.

Figure 6:
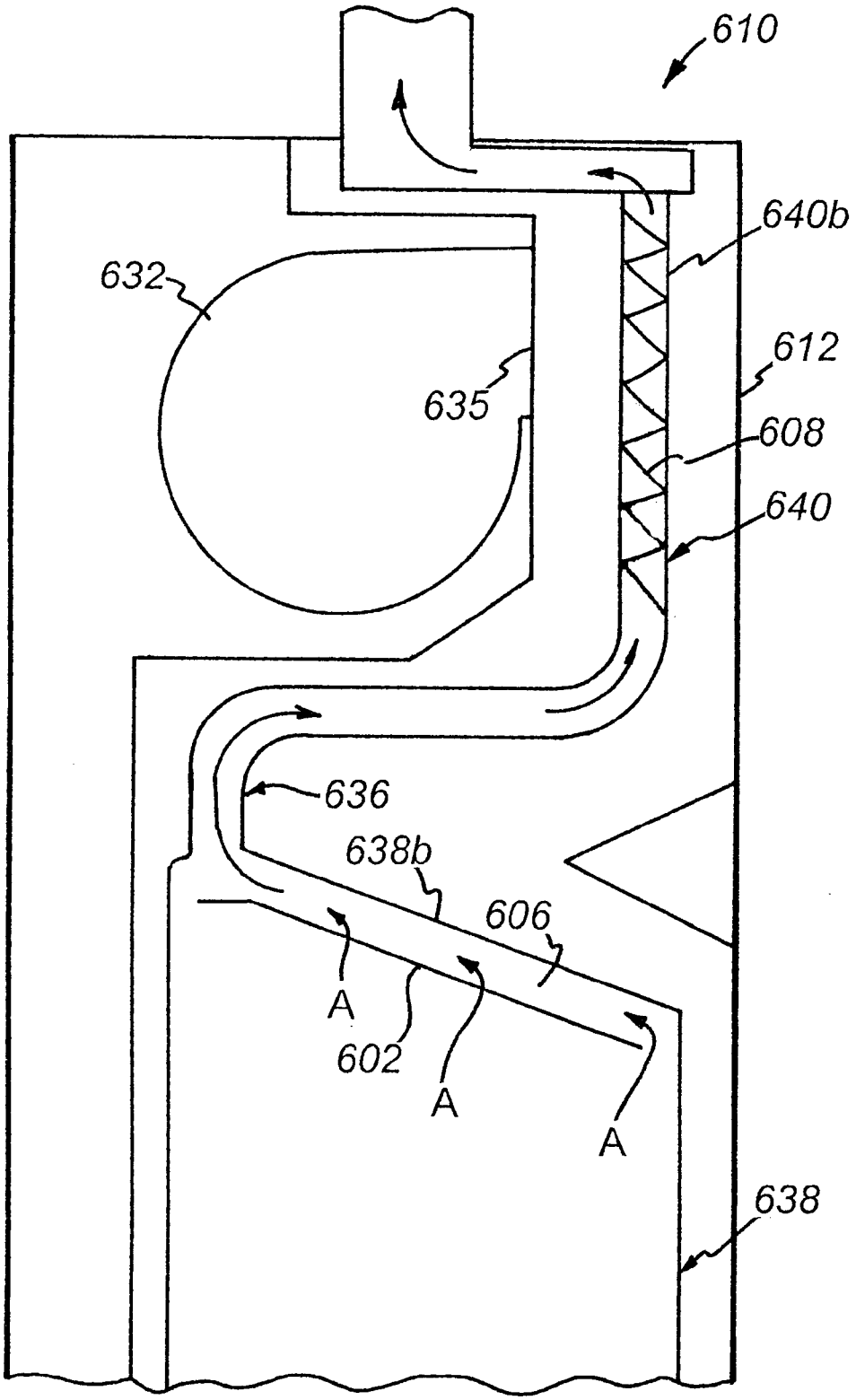
FIG. 6 is a highly schematic cross-sectional view of another embodiment of the furnace of the present invention.

It should be understood that other arrangements and geometries may similarly be utilized with the present invention FIG. 6 is a highly schematic cross sectional view of a furnace 610 that is similar to furnace 10 (FIGS. 1 and 2). Furnace 610 includes a heat exchanger 636 having a drum 638 and a plurality of tubes 640. The heat exchanger 636 being disposed within a housing 612. The furnace 610 further includes a circulating blower 632 having an outlet 635. Disposed within an upper portion 638*b* of drum 638 is a first baffle 602. The baffle 602, which may be formed from sheet metal, preferably extends substantially parallel to the upper surface of drum 638*b*, thereby defining a flow channel 606 along the top of the drum 638. The periphery of the baffle 602 is preferably spaced slightly apart from inner surface of the drum 638 so that combustion gases may flow around the periphery and along channel 606 as shown by arrows A. A second baffle or series of small baffles 608 may also be disposed within the tubes 640. More specifically, the baffles 608 are disposed within vertical portions 640*b* of tubes 640 adjacent to the outlet 635 of the circulating blower 632.

During operation, hot combustion gases generated by a burner assembly (not shown) flow upwardly within drum 638, around the periphery of the baffle 602 and enter the channel 606. The combustion gases flow along the channel 606, exit the drum 638 and enter the tubes 640. The flow of hot combustion gases within the channel 606 raises the temperature of the top of the drum 638. Since the room air being heated within the furnace 610 first contacts the drum 638 at its upper surface, the addition of baffle 606 improves the heat transfer characteristics of furnace 610. Next, the combustion gases flow through the tubes 640. The second baffle 608 promotes turbulence or a scrubbing action within the tubes 640. This allows even more heat from the combustion gases to be used to heat tubes 640 which, in turn, heat the room air being drawn into the furnace 610 by circulating blower 632.

It should be understood that other baffle arrangements may also be advantageously used.

Figure 7A:
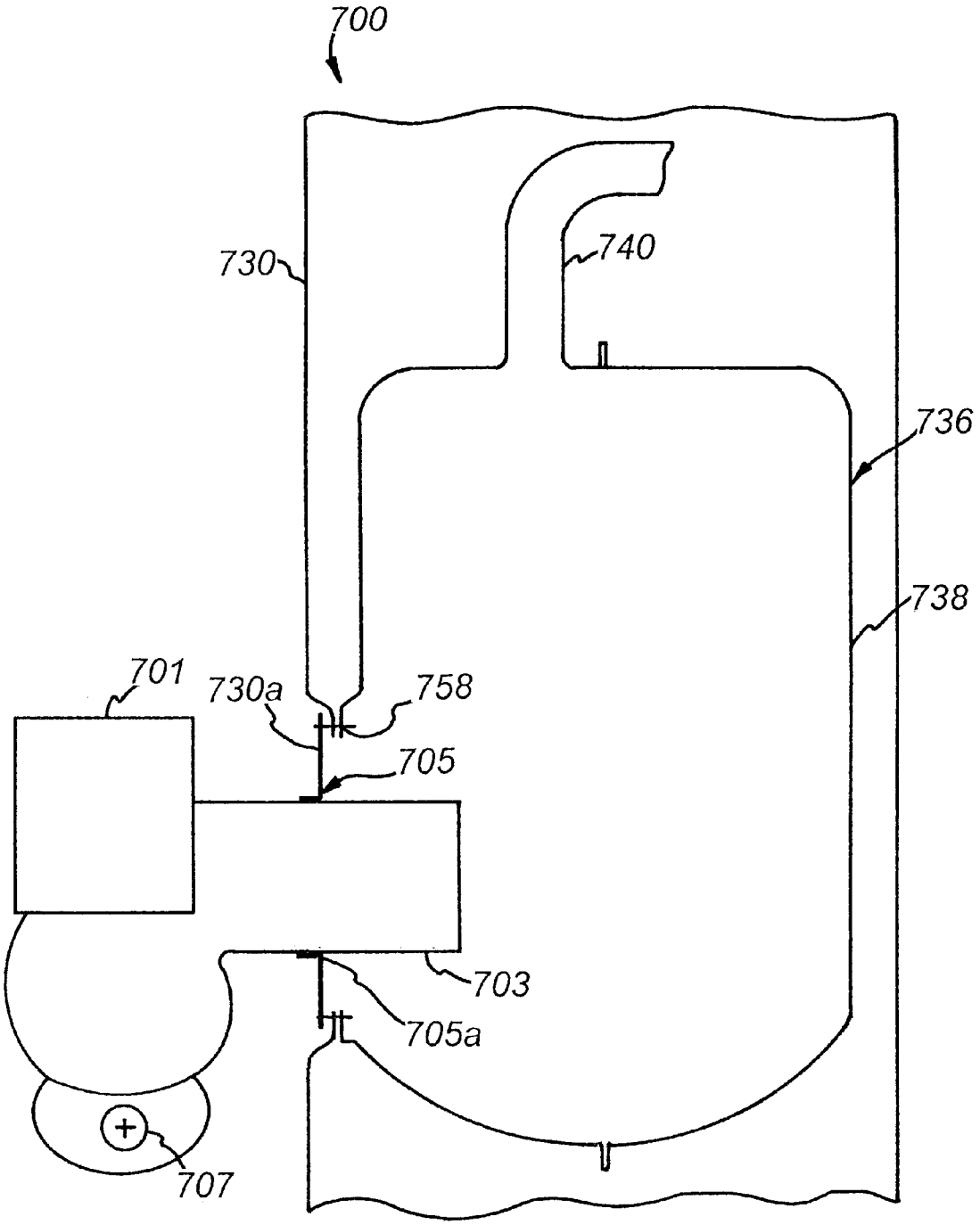
FIG. 7A is a partial cross-sectional view of the furnace of the present invention including a gas gun burner.
Figure 7B:
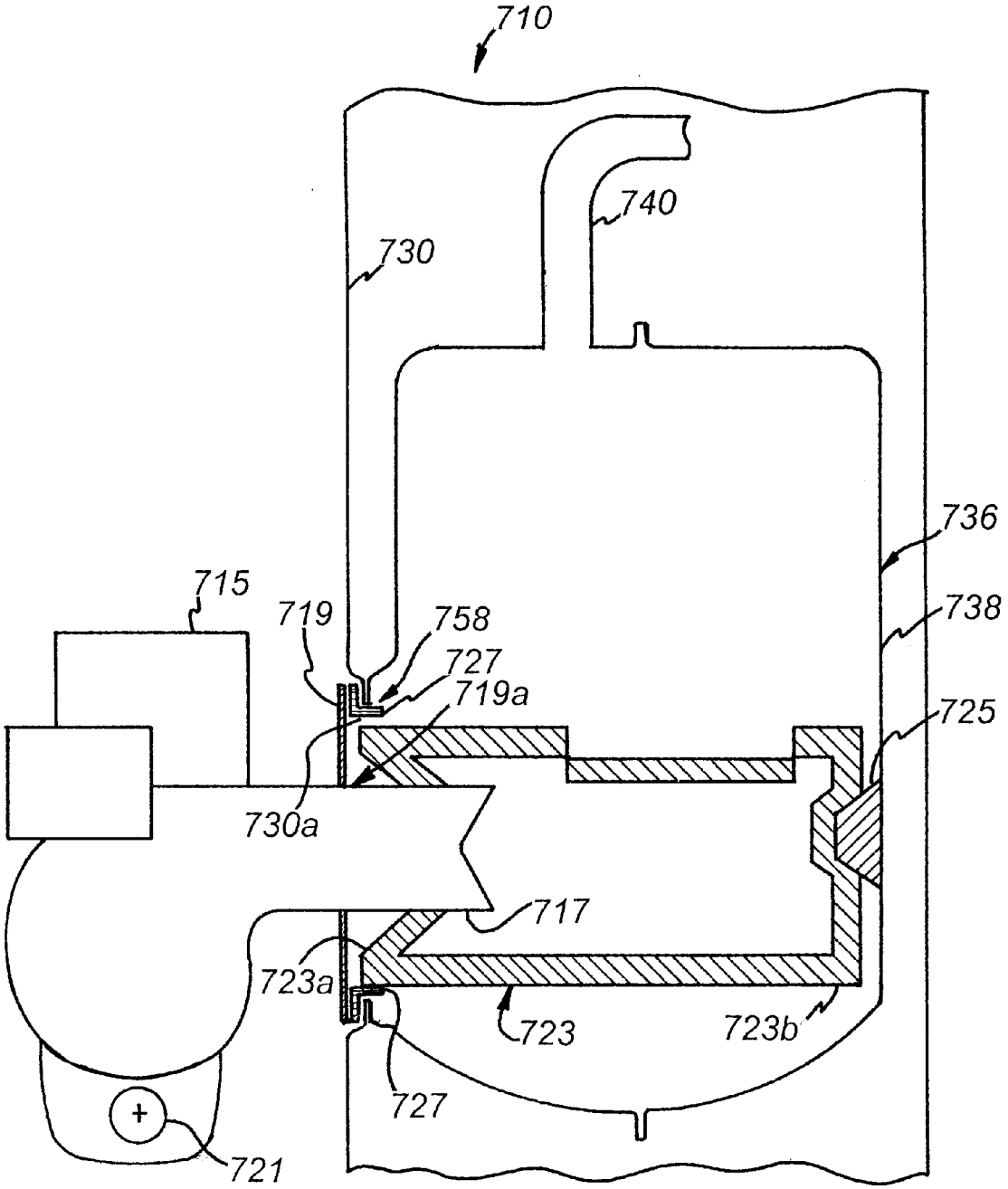
FIG. 7B is a partial cross-sectional view of the furnace of the present invention including an oil-fired burner.

In addition to the modular aspects of the drum and tube heat exchanger 36 (FIG. 3), passageway 30*a* and drum opening 58 are preferably configured to accommodate a wide variety of burners for use with furnace 10, including burners that are much larger than gas burner assembly 46. FIGS. 7A and 7B arc each highly schematic cross-sectional views of the lower portion of a furnace having many similar components as furnace 10 (FIGS. 1 and 2), but illustrating the use of alternative burners. More specifically, FIG. 7A is a cross-sectional view of a portion of a furnace 700 showing the installation of a gas gun burner 701. The furnace 700 includes an intermediary wall 730 having a passageway 730*a* and a heat exchanger 736 including a drum 738 and a plurality of tubes 740. The drum 738, moreover, has a drum opening 758 for receiving a portion of the gas gun burner 701. In particular, the gas gun burner 701, which includes a barrel 703, mounts to a burner support plate 705, which, in turn, is mounted directly to the front of intermediary wall 730 at passageway 730*a*. More specifically, the lower airbox 48 (FIG. 3) and entry plate 64, utilized with the gas burner assembly 46 described above, are omitted in this installation. Instead, the barrel 703 of the gas gun burner 701 simply extends through an opening 705*a* in support plate 705, through passageway 730*a* of wall 730 and into drum 738 via drum opening 758.

The gas gun burner 701 includes a combustion air inlet port 707 for receiving combustion air. The air inlet port 707 is preferably coupled to the lower end of an inlet air conduit (not shown) within furnace 700 by a flexible hose (not shown). That is, instead of a lower airbox, the gas gun burner 701 receives its combustion air from the air inlet conduit through a flexible hose.

FIG. 7B is a cross-sectional view of a portion of a furnace 710 showing the installation of an oil-fired burner 715. The furnace 710 similarly includes an intermediary wall 730 having a passageway 730*a* and a heat exchanger 736 including a drum 738 and a plurality of tubes 740. In this installation, a ring/collar 727 is mounted to passageway 730*a*. The drum 738, moreover, has a drum opening 758 for receiving a portion of oil burner 715. In particular, the oil burner 715, which includes a barrel 717, mounts to a burner support plate 719, which, in turn, is mounted to the ring/collar 727 at passageway 730*a*. Again, the lower airbox 48 (FIG. 3) and entry plate 64, utilized with the gas burner assembly 46 described above, are omitted in this installation. Rather, the barrel 717 of the oil burner 715 simply extends through an opening 719*a* in support plate 719, through passageway 730*a* of wall 730 and into drum 738 via drum opening 758.

Additionally, the oil burner 715 includes a combustion air inlet port 721 for receiving combustion air. The air inlet port 721 is preferably coupled to the lower end of an inlet air conduit (not shown) by a flexible hose (not shown). That is, instead of a lower airbox, the oil burner 715 (like the gas gun burner 701) receives its combustion air from the inlet air conduit through a flexible hose. With the installation of the oil burner 715, a combustion chamber 723 is preferably mounted inside the drum 738, since the corresponding oil-fired flame is typically hotter and more focused. The purpose of the combustion chamber 723, which may be ceramic, is to confine and redistribute the flame so as to avoid overheating of the drum 736. In particular, the combustion chamber 723 includes two opposing ends 723*a*, 723*b* and preferably extends across the drum 738. In particular, a first end 723*a* of the combustion chamber 723 may be mounted to the inner surface of the drum 738 at drum opening 758 so that the chamber 723 surrounds that portion of the barrel 717 of the oil burner 715 extending into the drum 738. A second end 723*b* of the chamber 723 may be mounted to a support bracket 725 located within the drum 738 opposite the drum opening 758.

As shown, the passageway 730*a* of intermediary will 730 and the opening 758 of drum 738 are preferably configured to accommodate a range of burner sizes including atmospheric burners, gas gun burners, oil-fired burners, etc. This allows a single furnace design to accommodate multiple burner installations.

Figure 8:
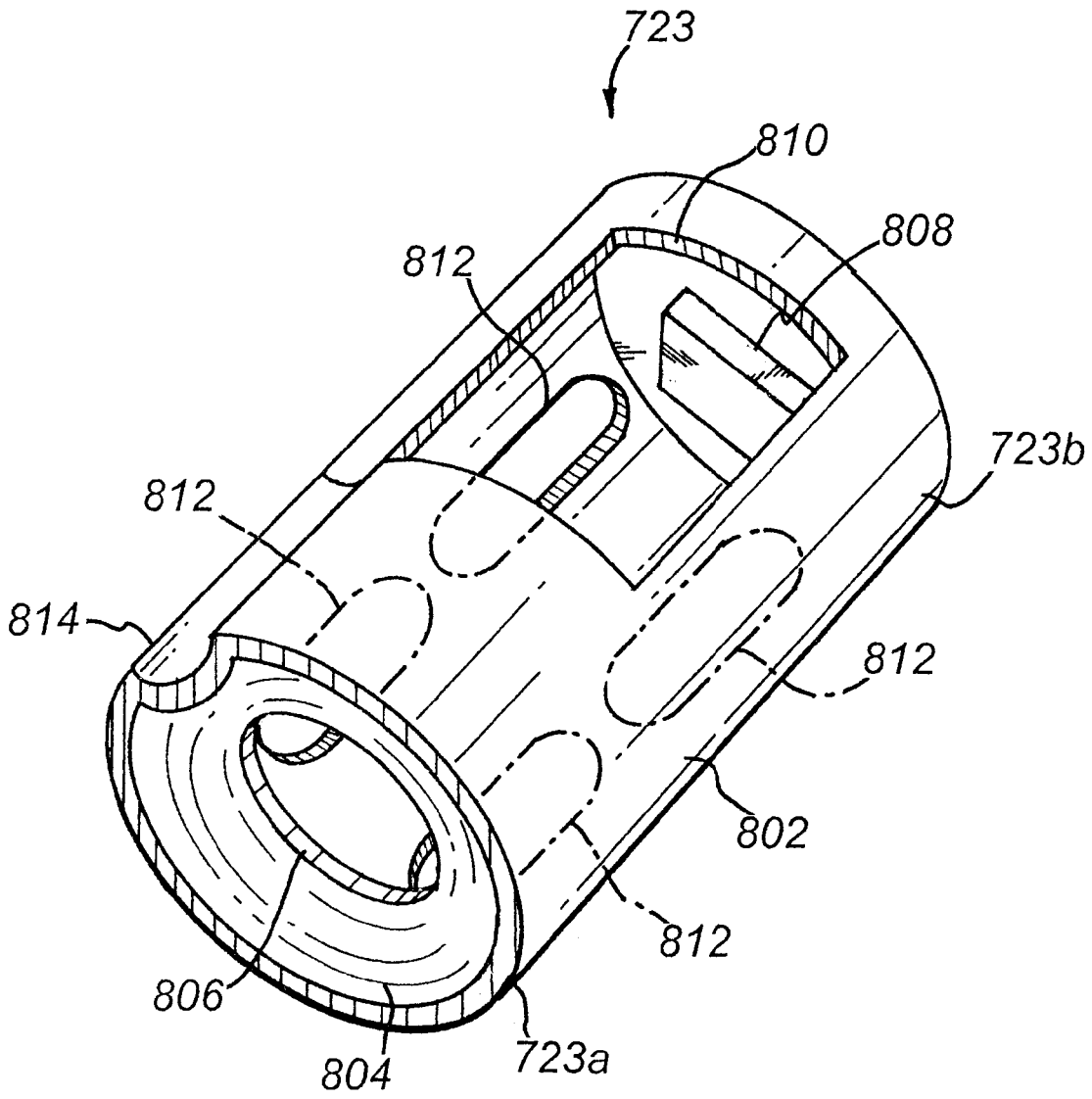
FIG. 8 is an isometric view of the combustion chamber of FIG. 7B.

FIG. 8 is an isometric view of the combustion chamber 723. The chamber 723 has a cylindrically shaped outer wall 802. A conical entry 804 defining an inlet 806 for receiving the barrel 717 (FIG. 7B) of the oil burner 715 is located at the first end 723*a* of the chamber 723. Formed within second end 723*b* is a receiving detent 808 that is configured to engage the support bracket 725 (FIG. 7B) located within the drum 738. The combustion chamber 723 further includes a relatively large primary opening 810 formed in the upper portion of the wall 802. Primary opening 810, which may represent one-half to two-thirds of the upper portion of the wall 802, may be substantially rectangular in platform and disposed proximate to the second end 723*b*. The chamber 723 further includes a plurality of secondary openings 812 that are located substantially within a lower portion of the wall 802 opposite the primary opening 810. In the preferred embodiment, the combustion chamber 723 has four secondary openings 812. The secondary openings 812, moreover, may be elliptically shaped with their major axes aligned with the axis of the cylindrical chamber 723. The combustion chamber 723 also includes a groove passage 814 that extends axially along the upper portion of the wall 802.

The chamber 723 is preferably installed within the drum 738 (FIG. 7B) with its axis perpendicular to the vertical axis of the drum 738. That is, the horizontal cylindrical chamber 723 is mounted within the vertical drum 738. In addition, upon installation of the chamber 723, the detent 808 engages the support bracket 725 at the back of the drum 738. The support bracket 725 and the detent 808 are mutually configured to fix the position of the chamber 723 within the drum 738. That is, with the bracket 725 engaged in the detent 808, the chamber 723 is precluded from rotating or otherwise becoming misaligned within the drum 738. The bracket 725 and detent 808 further ensure that the chamber 723 is positioned within the drum 738 so that the primary opening 810 faces upward relative to the tubes 740 and the secondary openings 812 face downward.

During operation of the oil-fired burner 715, the corresponding flame is discharged within the combustion chamber 723. A significant portion of the flame (and thus heat) exits the chamber 723 through the relatively large primary opening 810. This causes the upper portions of the drum 738 to be heated. Nonetheless, a portion of the flame and heat also exits the chamber 723 through the secondary openings 812, causing the lower portions of the drum 738 to be heated. As a result, the primary and secondary openings 810, 812 cooperate to evenly heat the entire drum 738. That is, the use of primary and secondary openings 810, 812, as shown, avoids the nonuniform heating and potential localized overheating common with prior art combustion chamber designs.

In addition, the groove passage 814 allows service personnel to view the flame generated by the oil burner 715 during operation of the furnace 710. More specifically, the burner support plate 719 (FIG. 7B) preferably includes a small, hinged viewing door (not shown) that is accessible from outside the furnace 710 and aligned with the groove passage 814 of the combustion chamber 723. By opening the viewing door and looking down along the passage 814, service personnel are able to inspect the flame during operation of the burner 715. Thus, the combustion chamber 723 of the present invention, including the groove passage 814, permits service and inspection functions that are unavailable in the prior art combustion chamber designs.

The foregoing description has been directed to specific embodiments of the present invention. It will be apparent, however, that other variations and modifications may be made to the described embodiments, with the attainment of some or all of their advantages. Therefore, it is the object of the appended claims to cover all such variations and modifications as come within the true spirit and scope of the invention.

What is claimed is:

1. A furnace disposed within a housing having at least a rear wall, the furnace comprising:

a circulating blower disposed within the housing and having a fan outlet, the circulating blower configured to draw room air into the housing and to discharge the room air from the fan outlet in a first direction;

a heat exchanger assembly having a drum with an open interior and a plurality of serpentine shaped tubes in fluid communication with the interior of the drum, the drum disposed below the circulating blower and the tubes extending from the drum in a generally upward direction adjacent to the circulating blower such that room air discharged from the fan outlet flows around the tubes of the heat exchanger and is directed toward the drum;

an inlet air conduit disposed within the housing, the inlet air conduit coupled to a supply of combustion air;

a lower airbox coupled to the inlet air conduit for receiving combustion air and in fluid communication with the interior of the drum, the lower airbox having a curved inlet air channel configured and arranged to smoothly turn the received combustion air from the inlet air conduit toward the interior of the drum; and a burner assembly mounted to the lower airbox and extending at least partially into the interior of the drum, the burner assembly configured and arranged to receive combustion air from the lower airbox and including a venturi tube with an end and a target plate spaced from and facing the end of the venturi tube, the target plate tilted inwardly relative to the end of the venturi tube such that the target plate is free from having any outwardly tilting portion.

2. The furnace of claim 1 wherein the burner provides a fuel-air mixture that is ignited within the interior of the drum and the target plate includes a plurality of outwardly extending fingers for improving the fuel-air mixture.

3. The furnace of claim 2 wherein the target plate is generally planar and the fingers are within the plane of the target plate.

4. The furnace of claim 3 wherein the target plate is mounted to an arm extending from the venturi tube.

5. The furnace of claim 4 wherein the target plate includes an upper edge and the fingers of the target plate are disposed primarily along the upper edge.

6. The furnace of claim 5 wherein the inward tilt of the target plate is approximately twenty-five degrees.

7. The furnace of claim 6 wherein the target plate generates a stable, round ball of flame within the interior of the drum during operation of the burner assembly.

8. The furnace of claim 1 wherein the inlet air conduit has a central axis and the furnace further comprises a combustion fan assembly disposed within the inlet air conduit, the combustion fan assembly comprising:

at least one propeller for generating an axial air flow;

a motor operatively coupled to the at least one propeller; and a stator disposed downstream of the at least one propeller relative to the airflow, the stator including one or more vanes that are generally parallel to or include the central axis for straightening the airflow generated by the at least one propeller.

9. A furnace disposed within a housing having at least a rear wall, the furnace comprising:

a circulating blower disposed within the housing and having a fan outlet, the circulating blower configured to draw room air into the housing and to discharge the room air from the fan outlet in a first direction;

a heat exchanger assembly having a drum with an open, interior and a plurality of serpentine shaped tubes in fluid communication with the interior of the drum, the drum disposed below the circulating blower and the tubes extending from the drum in a generally upward direction adjacent to the circulating blower such that room air discharged from the fan outlet flows around the tubes of the heat exchanger and is directed toward the drum;

an inlet air conduit disposed within the housing, the inlet air conduit coupled to a supply of combustion air; and an intermediary wall extending at least partially alongside the drum, wherein the drum and the intermediary wall cooperate to receive any one of:

(i) an entry plate, a lower airbox and a natural draft gas burner assembly extending through the intermediary wall and into the drum;

(ii) a first burner support plate for supporting a gas gun burner extending through the intermediary wall and into the drum; or (iii) a second burner support plate for supporting an oil burner extending through the intermediary wall and into the drum.

10. The furnace of claim 9 wherein the furnace is capable of generating a thermal output in response to a given thermal input to define a thermal efficiency, and the heat exchanger includes means for maintaining a substantially constant thermal efficiency despite changes in the thermal input.

11. The furnace of claim 10 wherein the maintaining means includes means for increasing and/or decreasing the number of tubes extending from the drum.

12. The furnace of claim 10 wherein the tubes have an inside diameter and the maintaining means includes means for increasing and/or decreasing the inside diameter of the tubes.

13. The furnace of claim 9 wherein the inlet air conduit has a central axis and the furnace is configured to include the entry plate, the lower airbox and the natural draft gas burner assembly and further comprises a combustion fan assembly disposed within the inlet air conduit, the combustion fan assembly comprising:

at least one propeller for generating an axial air flow;

a motor operatively coupled to the at least one propeller; and a stator disposed downstream of the at least one propeller relative to the airflow, the stator including one or more vanes that are generally parallel to or include the central axis for straightening the airflow generated by the at least one propeller.

14. A combustion chamber for use in a furnace having an oil-fired burner with a nozzle and a heat exchanger having a drum with an inside surface and a mounting bracket located on the inside surface of the drum, the combustion chamber comprising:

a generally cylindrical outer wall having upper and lower portions;

a primary opening formed in the upper portion of the outer wall;

a plurality of secondary openings formed in the lower portion of the outer wall;

a first end having a conical entry defining an inlet for receiving the barrel of the oil-fired burner; and a second end having a detent configured to receive the mounting bracket in mating engagement upon installation of the combustion chamber within the drum.

15. The combustion chamber of claim 14 further comprising a groove passageway extending axially along the outer wall.

16. The combustion chamber of claim 15 having four secondary openings.

17. A furnace disposed within a housing having at least a rear wall, the furnace comprising:

a circulating blower disposed within the housing and having a fan outlet, the circulating blower configured to draw room air into the housing and to discharge the room air from the fan outlet in a first direction;

a heat exchanger assembly having a drum with an open interior and a plurality of serpentine shaped tubes in fluid communication with the interior of the drum, the drum disposed below the circulating blower and the tubes extending from the drum in a generally upward direction adjacent to the circulating blower such that room air discharged from the fan outlet flows around the tubes of the heat exchanger and is directed toward the drum;

an inlet air conduit disposed within the housing, the inlet air conduit coupled to a supply of combustion air;

a lower airbox coupled to the inlet air conduit for receiving combustion air and in fluid communication with the interior of the drum, the lower airbox having a curved inlet air channel configured and arranged to smoothly turn the received combustion air from the inlet air conduit toward the interior of the drum; and a burner assembly mounted to the lower airbox and extending at least partially into the interior of the drum, the burner assembly configured and arranged to receive combustion air from the lower airbox and including a venturi tube with an end and a target plate spaced from and facing the end of the venturi tube, the target plate tilted inwardly relative to the end of the venturi tube, wherein the burner provides a fuel-air mixture that is ignited within the interior of the drum and the target plate includes a plurality of outwardly extending fingers for improving the fuel-air mixture.

18. The furnace of claim 17 wherein the target plate is generally planar and the fingers are within the plane of the target plate.

19. The furnace of claim 18 wherein the target plate is mounted to an arm extending from the venturi tube.

20. The furnace of claim 19 wherein the target plate includes an upper edge and the fingers of the target plate are disposed primarily along the upper edge.

21. The furnace of claim 20 wherein the inward tilt of the target plate is approximately twenty-five degrees.

22. The furnace of claim 21 wherein the target plate generates a stable, round ball of flame within the interior of the drum during operation of the burner assembly.

23. The furnace of claim 17 wherein the inlet air conduit has a central axis and the furnace further comprises a combustion fan assembly disposed within the inlet air conduit, the combustion fan assembly comprising:

at least one propeller for generating an axial air flow;

a motor operatively coupled to the at least one propeller; and a stator disposed downstream of the at least one propeller relative to the airflow, the stator including one or more vanes that are generally parallel to or include the central axis for straightening the airflow generated by the at least one propeller.

24. A combustion chamber for use in a furnace having an oil-fired burner with a nozzle, the combustion chamber comprising:

a generally cylindrical outer wall having upper and lower portions;

a primary opening formed in the upper portion of the outer wall;

a plurality of secondary openings formed in the lower portion of the outer wall;

a first end having a conical entry defining an inlet for receiving the barrel of the oil-fired burner; and a groove passageway extending axially along the outer wall for inspecting a flame disposed within the combustion chamber.

25. The combustion chamber of claim 24 having four secondary openings.

* * * * *